US006536685B2

(12) United States Patent
Bennett

(10) Patent No.: US 6,536,685 B2
(45) Date of Patent: Mar. 25, 2003

(54) FOAMER

(75) Inventor: Robert Alfred Bennett, Easton, CT (US)

(73) Assignee: Unilever Home and Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/810,144

(22) Filed: Mar. 16, 2001

(65) Prior Publication Data

US 2002/0130198 A1 Sep. 19, 2002

(51) Int. Cl.[7] ..... B05B 7/30; B05B 7/32

(52) U.S. Cl. ..... 239/343; 239/337; 239/339; 239/354; 239/356; 239/363; 239/368; 239/369; 239/370; 239/372; 239/399; 239/405; 239/462; 239/463; 239/472; 239/DIG. 23

(58) Field of Search ..... 239/327, 328, 239/337, 339, 343, 354, 349, 356, 363, 368, 369, 370, 372, 399, 403, 405, 406, 462, 494, 575, DIG. 23, 463, 472; 222/190, 189.1, 211, 212

(56) References Cited

U.S. PATENT DOCUMENTS

| | | | | |
|---|---|---|---|---|
| 4,147,306 A | | 4/1979 | Bennett | |
| 4,156,505 A | | 5/1979 | Bennett | |
| 4,247,025 A | * | 1/1981 | Gailitis | 239/404 |
| 4,402,432 A | * | 9/1983 | Corsette | 222/321.2 |
| 4,420,098 A | | 12/1983 | Bennett | |
| 4,773,570 A | | 9/1988 | Workum | |
| 5,033,654 A | | 7/1991 | Bennett | |
| 5,064,103 A | | 11/1991 | Bennett | |
| 5,156,307 A | | 10/1992 | Callahan et al. | |
| 5,255,851 A | | 10/1993 | Tobler | |
| 5,271,530 A | * | 12/1993 | Uehira et al. | 222/190 |
| 5,289,952 A | | 3/1994 | Gueret | |
| 5,310,093 A | | 5/1994 | Bennett | |
| 5,348,189 A | | 9/1994 | Cater | |
| 5,443,569 A | * | 8/1995 | Uehira et al. | 222/190 |
| 5,462,208 A | * | 10/1995 | Stahley et al. | 222/190 |
| 5,467,898 A | | 11/1995 | Hori | |
| 5,570,819 A | | 11/1996 | Uehira et al. | |
| 5,605,258 A | * | 2/1997 | Abplanalp | 239/337 |
| 5,611,490 A | | 3/1997 | Barriac et al. | |
| 6,244,473 B1 | * | 6/2001 | Keung et al. | 222/207 |
| 2001/0042761 A1 | | 11/2001 | Ophardt et al. | |

FOREIGN PATENT DOCUMENTS

| | | |
|---|---|---|
| EP | 0 392 238 A1 | 3/1990 |

* cited by examiner

*Primary Examiner*—Robin O. Evans
(74) *Attorney, Agent, or Firm*—Alan A. Bornstein

(57) ABSTRACT

A foam dispenser utilizes a deformable reservoir, a foamable fluid and air or other gas; a discharge device and an arrangement for producing foam that includes a plurality of mesh screens. When the dispenser is operated, air from inside the dispenser is mixed with the fluid to produce foam. The dispenser employs a shaped and resilient deformable seal for use in quickly recharging the container with air used in the creation of foam. The dispenser also advantageously employs an integrally molded swirl manifold to create a foam of excellent quality and consistency.

19 Claims, 3 Drawing Sheets

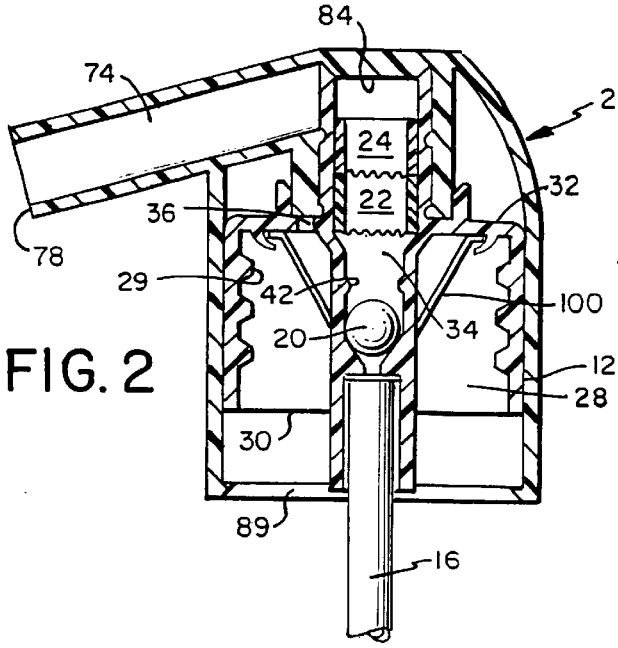
FIG. 2
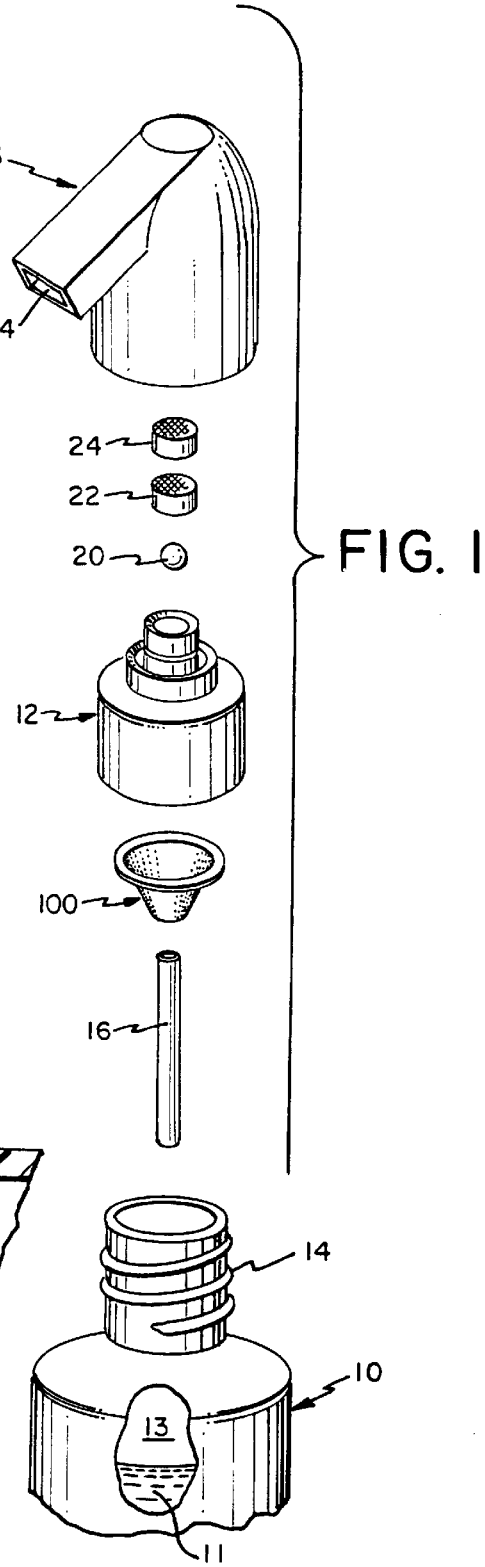
FIG. 1
FIG. 8
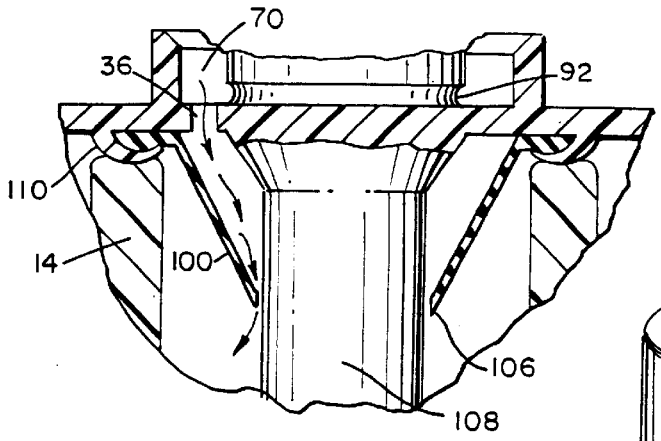

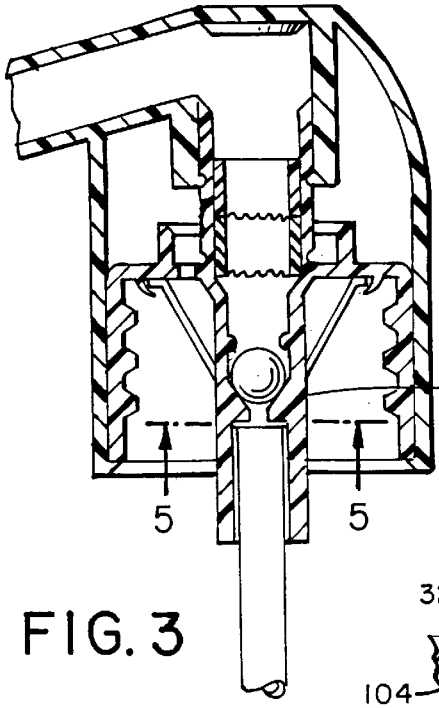
FIG. 3
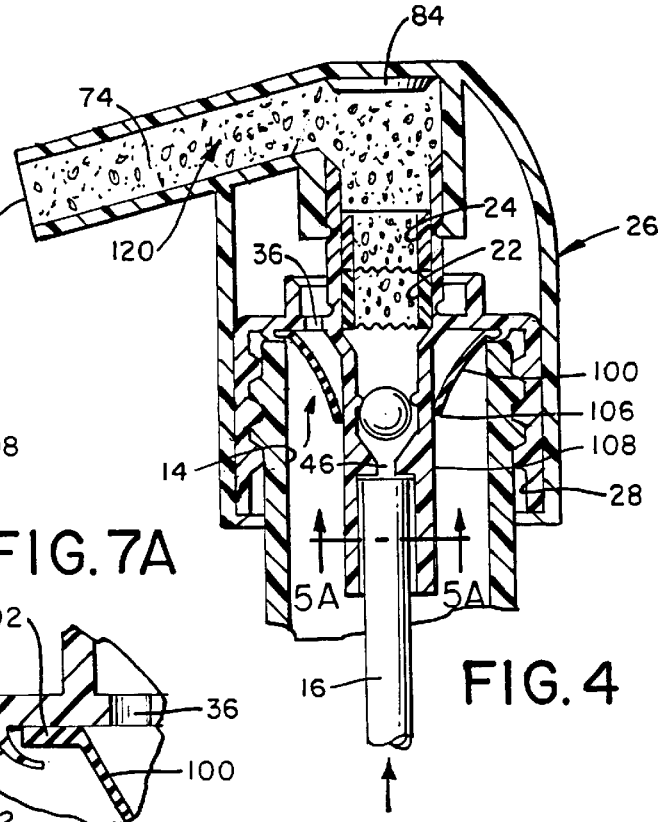
FIG. 7A
FIG. 4
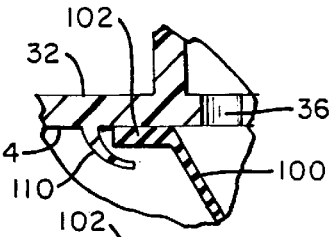
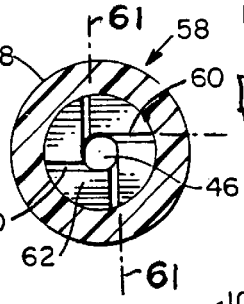
FIG. 5
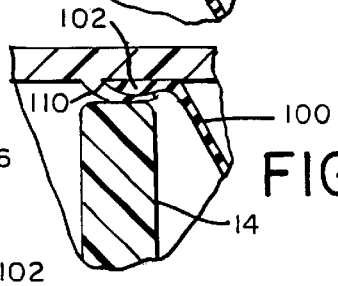
FIG. 7B
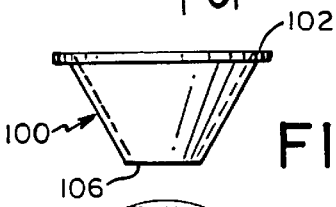
FIG. 9A
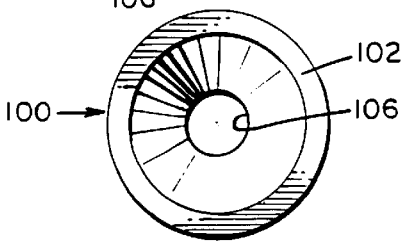
FIG. 9B
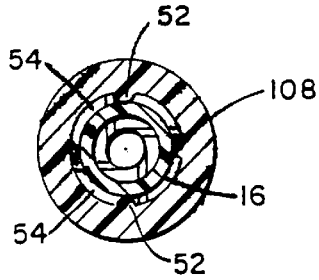
FIG. 5A

FOAMER

BACKGROUND OF THE INVENTION

1. Field of the Invention

This invention relates to a foam-producing device.

2. The Related Art

Certain known types of foam producing devices are disclosed in U.S. Pat. No. 4,147,306 and U.S. Pat. No. 4,156,505 both issued to Bennett. These employ a deformable reservoir of foamable fluid and air, a discharge device and a foam producing device which include both a foam overlay or filter and a ball check valve. The foam-producing device has a well with air passages, which form a mixing chamber. When the reservoir is squeezed, the liquid and air are mixed in the chamber. The mixture is passed through the overlay to produce foam which is discharged through the orifice. The check valve is disposed in the path of liquid flow and is opened by the squeezing action and is closed when the pressure is released. The valve, when closed, prevents downward flow of liquid or foam which otherwise could clog or jam the dispenser. However, such arrangements suffer from certain other disadvantages.

For example, prior art devices have multiple parts which are costly to manufacture in quantity. Moreover, many of the prior art devices require a long time to recharge air that has been discharged from the container when foam has been produced. Accordingly, one aspect of the present invention is to provide a foam nozzle and dispenser at least as efficient as earlier devices, yet manufactured with fewer parts thereby saving some assembly cost and reducing complexity. Another aspect of the present invention is to provide a foam dispenser which rapidly recharges air between discharges of foam.

SUMMARY OF THE INVENTION

In the present invention, the disadvantages of prior foam nozzles and dispensers have been found to be overcome by using a shaped resilient seal which allows the container to recharge with air in a much more efficient manner. A swirl manifold is also advantageously employed to create good quality foam and, in a preferred arrangement, is cast as an integral component in the foam-generation housing of the instant invention. The inventive foam dispenser uses fewer parts and can be more easily assembled and, therefore, can be produced and sold at a much lower cost.

In one aspect of the invention, a nozzle for dispensing foam is provided including a foam generation housing; a mixing conduit with an outlet and an inlet disposed in the foam generation housing for blending fluid and vapor to generate foam, a plurality of spaced apart mesh screens for creating turbulence zones disposed in the mixing conduit adjacent to the outlet; and a swirl manifold fluidly communicating with the inlet and disposed downstream from the plurality of spaced apart mesh screens for contacting the fluid with vapor to create a swirling fluid and vapor flow pattern. The swirl manifold has a surface, and defines an aperture communicating with the mixing conduit inlet and the fluid conduit outlet. The manifold surface also has at least one swirl conduit in communication with the aperture and the vapor conduit outlet; wherein the vapor flows through the swirl conduit and enters the aperture tangentially.

The inventive nozzle preferably includes a fluid conduit and a vapor conduit each having an outlet and an inlet; and a vent; each disposed in the foam generation housing. The plurality of screens preferably includes a first screen, and a second screen disposed downstream from the first screen. Preferably, the nozzle also includes a foam conduit housing containing a foam conduit for transporting foam created in the mixing conduit, which communicates with the mixing conduit outlet; and an adapter fixedly connected to the foam conduit housing. Preferably the adapter is slidably coupled to an outer surface of the foam generation housing for movement between an open and a closed position, the open position allowing communication between the atmosphere and the fluid and vapor in a container and the closed position preventing communication between the atmosphere and the fluid and vapor in the container.

Preferably the inventive nozzle's foam conduit housing has a sealing projection and at least one detent positioned to engage the outer surface of the foam generation housing when the foam conduit housing is moved between the closed and the open position. Preferably the inventive nozzle further includes a check valve disposed in the mixing conduit for preventing the back flow of fluid and foam into the container.

Advantageously, the inventive nozzle has its swirl manifold integrally formed with the foam generation housing, and the manifold has a central aperture and the manifold surface has a plurality of etched swirl conduits tangentially communicating with the aperture, each of the swirl conduits having a major axis. Preferably the number of swirl conduits etched in the swirl manifold surface is in the range of 2 to about 50. More preferably the number of swirl conduits are at least two and the major axis of at least one swirl conduit is disposed at right angles to a major axis of a second swirl conduit.

In another aspect of the invention is a nozzle for dispensing foam, including a foam generation housing having a vent; a mixing conduit disposed in the foam generation housing for blending fluid and vapor to generate foam, the mixing conduit having an outlet and an inlet; a plurality of spaced apart mesh screens for creating turbulence zones disposed in the mixing conduit adjacent to the outlet; and a flared deformable vent seal for allowing the ingress of air into the container via the vent, the seal being disposed and movably engaged within the foam generation housing for movement between an open position allowing air ingress and a closed position when foam is discharged. In the context of the present invention, the flared character of the deformable vent seal is defined by the seal meeting a cylinder outer wall at an angle of less than 75 degrees in contrast to a flat seal which would meet the outer wall at an angle near 90 degrees.

Preferably the inventive nozzle's vent seal has a top wide end, a radially projecting flange connected to the wide end, and a narrow bottom end defining a seal aperture. The flange is in sealing engagement with a lower surface of the foam generation housing, and the seal bottom end is in sealing engagement with the cylinder outer wall of the foam generation housing.

Preferably the vent seal engages the cylinder outer wall at an angle defined by the seal and the cylinder outer wall in the range of about 35 to about 55 degrees, whereby negative pressure in the container causes the seal to move away from the outer wall allowing the egress air in the container. More preferably, the vent seal is conical in shape.

Advantageously, the inventive nozzle has an annular resiliently deformable ring concentrically disposed outside the mixing conduit and adapted to engage the vent seal and configured for movement between an open position and a closed position similar to a crab's claw. The open position for engaging at least a portion of the first resilently deformable seal, and the closed position for pressing the vent seal to the lower surface of the foam generation housing. More preferably, the annular resiliently deformable seal is integrally cast within the foam generation housing adjacent to the lower surface to reduce production costs.

In another aspect of the invention, the inventive nozzle is combined with a container to provide a foam dispenser. The container is coupled to the foam generation housing by the neck. The container will typically have threads, dimples, or the like to engage the nozzle. The nozzle will have complementary threads, depressions, or the like molded on an outer surface so as to engage the container and the annular resiliently deformable seal will then move to the closed position when the foam generation housing sealingly engages the container. Preferably the container threadably engages the foam generation housing.

In this aspect of the present invention, foam is dispensed by increasing the pressure in the container by any suitable means. Preferably the container is composed of a flexible polymeric material and the foam is dispensed by increasing the pressure in the container by deforming the container such as by squeezing by hand, using a bellows or pump device or source of pressurized gas, and the like. Preferably an external pumping device such as trigger pump commonly found in a trigger sprayer is not used. Such an external pumping device does not increase the pressure in the container. An example of such a trigger sprayer is described in U.S. Pat. No. 6,116,472 issued to Wanbaugh, et al. on Sep. 12, 2000.

In operation, the foam generation housing is secured to the open neck of a container of fluid, the fluid conduit inlet is extended into the container to a depth below the fluid level, and the vapor conduit inlet is extended into the vapor space of the container. When the nozzle in the open position and the container is squeezed or pressurized, the vent seal is forced closed sealing the vent. Vapor or air flows upwardly through the vapor conduit and the fluid flows upwardly through the fluid conduit. The fluid and air are mixed together in the swirl manifold disposed in the mixing conduit creating a vortex of fluid entrained with air. The fluid/air mixture passes through the check valve and the plurality of screens and is converted to foam. The foam flows through the foam conduit section of the nozzle and is discharged.

When the pressure is released, the vent seal opens and air is fed through the vent hole and passed the vent seal into the container to replace the air previously used to produce foam. After the pressure is equalized, the nozzle may be placed in the closed position. The dispenser is sealed and fluid cannot leak out even if the dispenser is tilted or inverted.

BRIEF DESCRIPTION OF THE DRAWINGS

The foregoing features, advantages, and objects of this invention are now described in more detail with reference to the drawings in which:

FIG. 1 is an exploded view of a preferred embodiment of the invention;

FIG. 2 is a cross sectional view of the embodiment of FIG. 1 in assembled form with the nozzle in down position;

FIG. 3 is a view similar to FIG. 2 but with the nozzle shown in up position prior to application of squeezing pressure;

FIG. 4 is a view similar to FIG. 3 with the nozzle shown in up position immediately after application of squeezing pressure;

FIG. 5 is a bottom planar view of the swirl manifold taken along line 2—2 in FIG. 3;

FIG. 5A is a bottom planar view of the swirl manifold taken along line 5A—5A in FIG. 4;

FIGS. 7A and 7B are detailed partial vertical cross sectional views of a preferred embodiment of the annular resilient or crab-claw ring receiving the flange of the vent seal shown in FIGS. 8, 9A, and 9B;

FIG. 8 is an operational partial cross sectional view of a preferred embodiment of the vent seal allowing the ingress of outside air into the container immediately after application of squeezing pressure;

FIG. 9A is a vertical cross sectional view of the vent seal shown in FIG. 8; and FIG. 9B is a top planar view of the vent seal shown in FIGS. 8 and 9A.

DETAILED DESCRIPTION

Figures 6A, 6B:
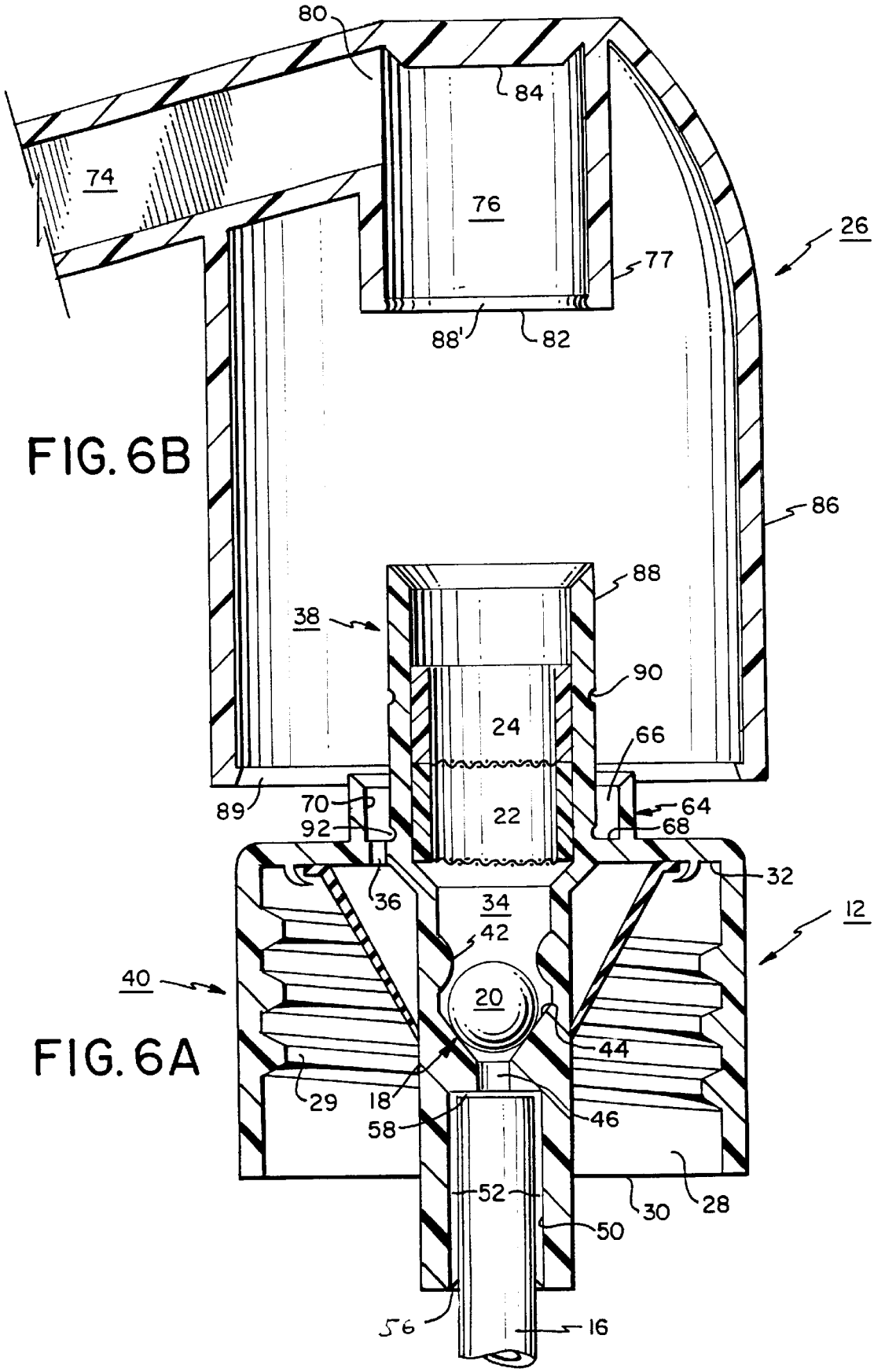
FIGS. 6A and 6B are detailed exploded cross sectional views of FIG. 2 showing the foam conduit holder and adapter in FIG. 6B being received onto the foam generation housing shown in FIG. 6A.

Referring now to FIGS. 1–9, a squeezable plastic container 10 contains foamable fluid 11 and air space 13. A plastic foam generation housing 12 is screwed on the open threaded neck 14 of container 10. A fluid conduit 16 extends downwardly from the housing 12 into the container to a point below the level of the fluid. A check valve 18, check valve ball 20, first screen 22, and second screen 24, are disposed in the housing 12. A foam conduit housing or plastic cap nozzle 26 is slidably connected to the housing 12.

Housing 12 is provided with a first vertical hollow cylinder 28 that has an open lower end 30 and a closed upper end 32. Cylinder 28 has an internal thread 29 and is adapted to engage an open neck 14 of container 10. The upper end of cylinder 28 has a centrally disposed mixing conduit 34, and a vent 36 located outside of and spaced from the mixing conduit 34.

The mixing conduit 34 extends above the upper end of cylinder 28. The mixing conduit 34 has an upper section 38 which communicates with a lower section 40 at the closed upper end 32 of the first cylinder 28. Upper section 38 contains the first screen 22 and second screen 24; Lower section 40 is adapted to receive check valve 18 with check valve ball 20 slidably disposed between point stops 42 and valve seat 44. The ball 20 normally engages the valve seat 44. Foam and air can flow through the check valve 18 when the ball 20 engages the point stops 42. Foam and air cannot flow through the check valve when the ball 20 engages the valve seat 44.

Situated downstream from the lower section 40 and in communication therewith is aperture 46. Downstream from aperture 46, vapor conduit 54 is adapted to receive fluid conduit 16 spaced apart from lower section wall 50 while fluid conduit 16 comes into pressing engagement with spacers 52 molded onto lower section wall 50. Vapor conduit 54 is annularly disposed around fluid conduit 16 and lower section wall 50 and communicates at its inlet 56 with the air space 13 in container 10.

Swirl manifold 58 is disposed in lower section 40. Swirl manifold 58 has a centrally disposed aperture 46 and a plurality of etched manifold swirl channels 60 etched into manifold surface 62 parallel with lines 5—5 and 5A—5A and each conduit 60 extending along major axis 61. Vapor conduit 54 communicates with aperture 46 via manifold swirl channels 60.

A second hollow cylinder 64 has an open upper end 66 and is secured at its lower end 68 to the upper end 32 of the first cylinder 28. The second cylinder 64 is disposed concentrically outside upper section 38 of the mixing conduit 34 and spaced therefrom by an annular recess 70, the vent 36 being disposed in communication with the annular recess 70.

Now referring to FIGS. 6A and 6B, the cap nozzle 26 has a horizontal discharge conduit section 74, a vertical hollow cylindrical section 76, and an adapter 86. The horizontal section has an outer discharge orifice 78 and an inner intake end 80. The vertical section 76 has an upper end which is connected to the intake end 80 and has a lower open mouth 82. The adapter 86 is slidably coupled to the upper outer surface 88 of the mixing conduit 34 for movement between an open position (FIG. 3) and a closed position (FIG. 2). The adaptor 86 has sealing ring 89 which engages detent go on upper outer surface 88 in the open position and engages detent 92 on lower outer surface 88 in the closed position. Adaptor 86 also has locking ring 91 which also engages lower end 30 of housing 12 when the foam nozzle is in the closed position.

The upper section 38 of the mixing conduit 34 extends into the vertical cylindrical section 76 in the closed position. In the closed or down position, the vertical section wall 77 extends into annular region 70 and closes the mixing conduit 34 via plug 84 and adaptor 86 closes the vent 36. In the open or up position, the vent 36 is exposed to ambient air which can pass into the interior of the first cylinder 28 and mixing conduit 34 is exposed to ambient air via horizontal conduit 74 and vertical section 76 to allow foam to be dispensed.

Now referring to FIGS. 7, 9A and 9B, the cone shaped vent seal 100 is disposed in the first cylinder 28. Seal 100 has flange 102 adjacent to the lower surface 104 of the closed upper end 32 of first cylinder 28 and its narrow bottom end 106 concentrically arranged outside of and adjacent to the cylindrical outer wall 108 of lower section 40. Flange 102 is engaged by annular or crab claw resilient seal 110 formed onto lower surface 104. Seal 110 presses flange 102 against the lower surface 104 when the housing 12 is threaded onto the neck 14 of the container 10 and tightened.

In use, the first cylinder 28 is secured to the open neck 14 of the container 10 and the fluid conduit 16 is placed in position to extend into the container to a depth below the fluid 11 level while the vapor conduit 54 is allowed to extend into the air space 13 of the container 10. When the nozzle 26 is in the up position and the container 10 is squeezed, the first annular seal 100 is forced closed. Air flows through the vapor conduit 52 and vapor swirl channel 60 and the fluid flows upwardly through the fluid conduit 16. The fluid 11 and air 13 are mixed together in the aperture 46 of the swirl manifold 58 and the swirling fluid-air mixture passes through the first 22 and second screens 24 and is converted to foam 120. The foam 120 flows through the vertical 76 and horizontal 74 section of the nozzle 26 and is discharged.

Simultaneously, the first annular resilient seal 100 prevents air 13 in the container 10 from escaping through the vent hole 36 due to the air pressure generated from squeezing the container 10 forcing the narrow bottom end 106 of seal 100 to sealingly press against outer wall 108.

After the desired amount of foam 120 is discharged and the squeezing pressure on the container 10 is relieved, outside air rapidly flows into container 10 to equalize the pressure therein through annular recess 70 and vent 36 passing between the vent seal 100 and outer wall 108 at the bottom end 106 of seal 100 and into the air space 13 of container 10 (see FIG. 8).

Vapor or air is aspirated into the swirl manifold of this invention where it mixes with the fluid. Pressure fluctuations in the vortex created in the swirl manifold are believed to affect the rate of air dissolution into the fluid and the amount of foaming is at least partially determined by the strength of vortex created in the manifold. The strength of the vortex is dependent on the pressure which the container is squeezed with, the design and location of the mesh screens, and the physical characteristics of the fluid being dispensed.

The ratio of fluid to air is also determinative of foaming quantity and quality. Time of exposure of air and fluid also affects the rate of air dissolution and therefore the amount of foaming. The time of exposure may be controlled by dimensioning the length of the mixing conduit. Factors affecting the selection of suitable dimensions are the amount of available aspirated air and the physical characteristics of the liquid, e.g. surface tension and viscosity. The quantity of available air depends on the volume of air in the container, how vigorously the foamer container is squeezed and the dimensions of the vapor conduit. These dimensions are again often empirically determined. A suitably dimensioned foamer in the preferred embodiment described herein has been found to have a container in the range of about 50 to about 250 mls, in volume, and a mixing conduit in the range of about 25 mm to about 150 mm in overall length. The length of the upper section of the mixing conduit can be in the range of approximately 25 mm to about 50 mm in length and about 6.2 to about 13.0 mm in radius. The length of the lower section of the mixing conduit can be in the range of about 9.5 to about 13.0 mm, and have a radius of about 3.1 to about 9.5 mm. The annular vapor conduit concentrically disposed around the fluid conduit has an inner radius of about 3.0 to about 7.4 mm, an outer radius of about 3.8 to about 7.6 mm, and a length of about 10.0 to about 15.3 mm. The cylindrical fluid conduit is about 25 to about 250 mm in length and about 4.0 to about 9.5 mm in radius. The swirl manifold surface has a diameter of about 6.2 to about 13.0 mm, and an aperture diameter of about 1.6 to about 6.2 mm. Preferably four rectangular swirl channels are etched in the surface of the swirl manifold and are orthogonal to each adjacent channel's linear axis. The dimensions of each swirl channel are typically about 3.1 to about 6.2 mm in length, about 0.3 to about 0.8 mm in depth, and about 0.3 to about 1.2 mm in width.

The inventive foamer has a plurality of mesh screens which reduces the amount of airborne droplets into the atmosphere while creating an acceptable quality foam which does not dribble when applied to the skin, and which has an acceptable hang time on the skin. The inventive foamer preferably has a pair of mesh screens each of a size of about 2 to about 5 openings per linear millimeter, the screens being spaced apart in at least one direction at a distance of about 6 to about 8 mm to establish a pair of turbulence zones as the flow direction of the spray particles is deflected when passing through the first screen and as the flow direction of the spray particles is further deflected when passing through the second screen.

The container body is preferably made of such material that enables the vessel to be squeezed by hand and rapidly restored to its original form upon recovery. Examples of suitable materials include thermoplastic resins such as polypropylene, polyethylene, polyethylene terephthalate, polyvinyl chloride, nylon, or laminates thereof, and the like. Transparent or opaque materials may be employed, but transparent or semi-transparent, colored or colorless materials are preferred to allow a check of the level of the contents in the container. As to materials for constituting the nozzle, thermoplastic resins such as polypropylene and polyethylene are preferably used, since tight engagement must be established between the nozzle and the container. The vent seal is preferably made of an elastomer material, but any other type of resilient material such as rubber, soft plastic, or other soft resilient seal material may be used. Preferably the material has a Shore or Durometer A scale hardness of less than about 100.

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

What is claimed is:

1. A nozzle for dispensing foam, comprising:

a foam generation housing;

a mixing conduit disposed in the foam generation housing for blending fluid and vapor to generate foam, the mixing conduit having an outlet and inlet;

a plurality of spaced apart mesh screens for creating turbulence zones disposed in the mixing conduit adjacent to the outlet, the plurality of screens including a first screen, and a second screen disposed downstream from the first screen;

a swirl manifold fluidly communicating with the inlet and disposed downstream from the plurality of spaced apart mesh screens for contacting the fluid with vapor to create a swirling fluid and vapor flow pattern, the swirl manifold having a surface, and defining an aperture communicating with the mixing conduit inlet and a fluid conduit outlet, the manifold surface having at least one swirl conduit in communication with the aperture and a vapor conduit outlet; wherein the vapor flows through the swirl conduit and enters the aperture tangentially; and a fluid conduit having an outlet and an inlet; a vapor conduit having an outlet and an inlet; and a vent; each disposed in the foam generation housing.

2. The nozzle of claim 1 wherein the plurality of swirl conduits are at least two and the major axis of at least one swirl conduit is disposed at right angles to a major axis of a second swirl conduit.

3. The nozzle of claim 1 further comprising:

a foam conduit housing;

a foam conduit for transporting foam created in the mixing conduit, the foam conduit disposed in the foam conduit housing and communicating with the mixing conduit outlet; and an adapter fixedly connected to the foam conduit housing, the adapter being slidably coupled to an outer surface of the foam generation housing for movement between an open and a closed position, the open position allowing communication between the atmosphere and the fluid and vapor in a container and the closed position preventing communication between the atmosphere and the fluid and vapor in the container.

4. The nozzle of claim 3 wherein the foam conduit housing has a sealing projection and at least one detent positioned to engage the outer surface of the foam generation housing when the foam conduit housing is moved between the closed and the open position.

5. The nozzle of claim 1 further comprising a check valve disposed in the mixing conduit for preventing the back flow of fluid and foam into the container.

6. The nozzle of claim 1 wherein the swirl manifold is integrally formed with the foam generation housing, the manifold having a central aperture and the manifold surface having a plurality of etched swirl conduits tangentially communicating with the aperture, each of the swirl conduits having a major axis.

7. The nozzle of claim 6 wherein the plurality of swirl conduits etched in the swirl manifold surface is in the range of 2 to about 50.

8. The nozzle of claim 3, further comprising:

a flared deformable vent seal for allowing the ingress of air into the container via the vent, the seal being disposed and movably engaged within the foam generation housing for movement between an open position allowing air ingress and a closed position when foam is discharged; and the container having a neck for containing the foamable fluid and the vapor space, the container being coupled to the foam generation housing by the neck.

9. The foam dispenser of claim 8 wherein the foam conduit housing has a sealing projection and at least one detent positioned to engage the outer surface of the foam generation housing when the foam conduit housing is moved between the closed and the open position.

10. The foam dispenser of claim 8 wherein the vent seal has a top wide end, a radially projecting flange connected to the wide end, and a narrow bottom end defining a seal aperture, the flange being in sealing engagement with a lower surface of the foam generation housing; the seal bottom end being in sealing engagement with an outer wall of the foam generation housing at an angle defined by the seal and the cylinder outer wall in the range of about 35 to about 55 degrees, whereby negative pressure in the container causes the seal to move away from the outer wall allowing the egress air in the container.

11. The foam dispenser of claim 8 wherein the container threadably engages the foam generation housing.

12. The foam dispenser of claim 8 wherein the foam is dispensed by increasing the pressure in the container.

13. The foam dispenser of claim 8 wherein the container is composed of a flexible polymeric material and the foam is dispensed by increasing the pressure in the container by deforming the container.

14. A nozzle for dispensing foam, comprising:

a foam generation housing having a vent;

a mixing conduit disposed in the foam generation housing for blending fluid and vapor to generate foam, the mixing conduit having an outlet and an inlet;

a plurality of spaced apart mesh screens for creating turbulence zones disposed in the mixing conduit adjacent to the outlet; and a flared deformable vent seal for allowing the ingress of air into a container via the vent, the seal being disposed and movably engaged within the foam generation housing for movement between an open position allowing air ingress and a closed position when foam is discharged.

15. The nozzle of claim 14, wherein the vent seal has a top wide end, a radially projecting flange connected to the wide end, and a narrow bottom end defining a seal aperture, the flange being in sealing engagement with a lower surface of the foam generation housing; the seal bottom end being in sealing engagement with a cylinder outer wall of the foam generation housing.

16. The nozzle of claim 15 wherein the vent seal engages the cylinder outer wall at an angle defined by the seal and the cylinder outer wall in the range of about 35 to about 55 degrees, whereby negative pressure in the container causes the seal to move away from the outer wall allowing the egress air in the container.

17. The nozzle of claim 14 wherein the vent seal is conical in shape.

18. The nozzle of claim 14 wherein an annular resiliently deformable ring is concentrically disposed outside the mixing conduit and is adapted to engage the vent seal and configured for movement between an open position and a closed position; the open position for engaging at least a portion of the first resilently deformable seal; the closed position for pressing a first resiliently deformable seal to the lower surface of the foam generation housing.

19. The nozzle of claim 18 wherein the annular resiliently deformable seal is integrally cast within the foam generation housing adjacent to the lower surface.

* * * * *

UNITED STATES PATENT AND TRADEMARK OFFICE

CERTIFICATE OF CORRECTION

PATENT NO. : 6,536,685 B2
DATED : March 23, 2003
INVENTOR(S) : Bennett

It is certified that error appears in the above-identified patent and that said Letters Patent is hereby corrected as shown below:

Column 1,
Line 56, change "...nicating with the inlet and disposed downstream from the" to
-- ...nicating with the inlet and disposed upstream from the --

Column 4,
Line 53, change "communication therewith is aperture 46. Downstream from" to
-- communication therewith is aperture 46. Upstream from --

Column 7,
Line 20, change "mixing conduit having an outlet and inlet" to -- mixing conduit having an outlet and an inlet --
Line 28, change "disposed downstream from the plurality of spaced apart" to
-- disposed upstream from the plurality of spaced apart --
Line 37, change "gentially; and a fluid conduit having an outlet and an" to
-- gentially; and a fluid conduit having the outlet and an --

Signed and Sealed this

Fourth Day of January, 2005

JON W. DUDAS
*Director of the United States Patent and Trademark Office*

UNITED STATES PATENT AND TRADEMARK OFFICE

CERTIFICATE OF CORRECTION

PATENT NO. : 6,536,685 B2
APPLICATION NO. : 09/810144
DATED : March 25, 2003
INVENTOR(S) : Bennett It is certified that error appears in the above-identified patent and that said Letters Patent is hereby corrected as shown below:

In column 4, line 65, please change "conduit" to:

--channel--

In column 5, line 17, please change "89" to:

--88'--

In column 5, line 17, please change "go" to:

--90--

In column 5, line 20, please change "... also has locking ring 91 which ..." to:

--... also optionally has a locking ring which ...--

In column 5, line 49, please change "52" to:

--54--

Signed and Sealed this

Third Day of April, 2007

JON W. DUDAS
*Director of the United States Patent and Trademark Office*